United States Patent [19]

Andrews et al.

[11] Patent Number: 4,862,185

[45] Date of Patent: Aug. 29, 1989

[54] VARIABLE WIDE ANGLE CONICAL SCANNING ANTENNA

[75] Inventors: George S. Andrews; Bernard J. Lamberty, both of Kent; Daniel J. Tracy, Maple Valley, all of Wash.

[73] Assignee: The Boeing Company, Seattle, Wash.

[21] Appl. No.: 177,966

[22] Filed: Apr. 5, 1988

[51] Int. Cl.[4] ..... H01Q 3/20

[52] U.S. Cl. ..... 343/761; 343/781 R; 343/839; 343/840

[58] Field of Search ..... 343/757–759, 343/761–763, 765, 766, 880, 882, 840, 839, 781 R, DIG. 2

[56] References Cited

U.S. PATENT DOCUMENTS

| | | | |
|---|---|---|---|
| 2,629,828 | 2/1953 | Cady et al. | 343/765 |
| 2,706,781 | 4/1955 | Goss | 343/765 |
| 3,141,168 | 7/1964 | Ashton | 343/765 |
| 3,949,404 | 4/1976 | Fletcher et al. | 343/781 R |
| 4,638,322 | 1/1987 | Lamberty | 343/761 |

*Primary Examiner*—Rolf Hille
*Assistant Examiner*—Michael C. Wimer
*Attorney, Agent, or Firm*—Christensen, O'Connor, Johnson & kindness

[57] ABSTRACT

Disclosed is a variable angle conical scanning antenna that employs an offset paraboloidal reflector which is rotated about an axis that extends through the focus of the paraboloid of revolution that defines the reflector. Electromagnetic energy is supplied to the reflector by an antenna feed that is mounted at the focus of the paraboloid of revolution and directed along the axis of rotation. In this arrangement the electromagnetic energy that is reflected from the offset paraboloidal reflector forms an angle between the axis of rotation and the beam of reflected electromagnetic energy that is equal to the angle between the axis of rotation and the focal axis of the paraboloid of revolution that defines the reflector. Thus, conical scanning at a cone angle that is equal to twice the angle between the axis of rotation and the reflected beam of electromagnetic energy is achieved as the offset paraboloidal reflector is rotated. Variable angle scanning (i.e., conical scanning over a range of cone angles) is achieved by tilting the offset paraboloidal reflector about the focus of the paraboloid of revolution that defines the reflector with the axis of antenna rotation and the focal axis of the paraboloid of revolution that defines the reflector remaining in substantial coplanar relationship.

15 Claims, 4 Drawing Sheets

VARIABLE WIDE ANGLE CONICAL SCANNING ANTENNA

BACKGROUND OF THE INVENTION

This invention relates to conical scanning antennas and, more particularly, to conical scanning antennas of variable scan angle.

Conical scanning antennas find application in numerous radio frequency transmitting and/or receiving system such as air-sea rescue and radar mapping systems. In such systems, it often is either necessary or desirable that the antenna be capable of both wide angle conical scanning and simultaneously be capable of controlling the scan angle over a relatively wide range of cone angles.

Although the prior art has provided arrangements capable of providing the relatively wide scan angles needed in most design situations, each previously proposed arrangement suffers from one or more distinct disadvantage or drawback. For example, the most straightforward approach to achieving wide angle conical scanning consists of moving the entire antenna assembly (including its associated electronics) and, in addition, configuring the transmission lines associated with the antenna and its electronics for movement with the antenna system. Generally, this is accomplished by configuring the transmission lines so that sufficient flexure is possible and/or providing conventional devices such as rotary joints that allow the necessry movement of the antenna assembly. Such an arrangement generally results in a complex system in which the antenna and other portions of the system that must be moved are relatively heavy and, thus, require a relatively large drive system that consumes a substantial amount of electrical energy. Further, flexing of the transmission lines and/or operation of rotary joints can cause other ditrimental effects such as high power arcing, impedance variations and changes in relative phase on adjacent transmission paths.

In another type of prior art system, a "splash plate" is rotated about a predetermined axis and an antenna feed directs electromagnetic energy at the splash plate center of rotation. In arrangements of this type, the conical scan angle depends upon the angle formed between the splash plate and the beam of electromagnetic energy that is supplied by the antenna feed. For example, when the antenna feed is directed along the axis of rotation with the splash plate being positioned so that the angle of incidence between the beam of arriving electromagnetic energy and the splash plate is 45°, a 360° scan is produced (e.g., the rotating radiated antenna beam forms a geometric plane, rather than the surface of a cone). When a flat splash plate is utilized, tilting the splash plate about the axis of rotation results in variable conical scanning over a wide range of cone angles. However, high gain operation is not achieved because the antenna gain is substantially equal to that of the antenna feed device (e.g., a feed horn). Although high gain operation can be achieved by utilizing a splash plate that corresponds to an offset parabolic reflector, with the antenna feed being positioned at the focus of the parabolic reflector, such an arrangement generally does not provide satisfactory operation for variable conical scanning applications. Specifically, tilting the parabolic reflector about its axis of rotation causes the feed to be laterally defocused, which, in turn, results in substantial loss of system efficiency (gain) and an increase in spurious directional radiation (increased side lobes), with both effects being proportional to the change in tilt angle.

Another prior art proposal for wide angle concial scanning employs phased antenna arrays in which the antenna elements of a large spherical or hemispherical array are individually fed with electrical signals and the phase relationships between the electrical signals that are fed to the arrayed antenna elements are controlled with respect to time so as to establish the desired conical scan. Such an approach is limited to operation over a relatively narrow band of frequencies and, further, results in a complex and expensive system that is at least as large as the reflectors utilized in other prior art approaches.

In another prior art arrangement, a reflector is defined by a paraboloid of revolution which is symmetrically disposed about a central axis that extends through the vertex of the parabola and the focus of the parabola. The reflector is rotated about a feed axis that is angularly offset from the central axis of the parabolic reflector. In this arrangement, the antenna feed is located at a fixed position on the feed axis and is offset from the focus of the parabolic reflector with the electromagnetic energy that is supplied by the antenna feed being directed at the vertex of the parabolic reflector. As the antenna rotates about the feed axis, both the beam of electromagnetic energy that is reflected from the antenna and the central axis of the reflector move through a conical scanning pattern. Although this arrangement, like the previously mentioned splash plate arrangements, eliminates the need for movement of the antenna feed, the arrangement is limited to conical scanning at relatively low cone angles. Specifically, lateral defocusing of the antenna occurs for wide angle conical can.

Nutating antenna feeds also have been employed in conical scan systems. In a nutating feed antenna, a reflector is utilized that is defined by rotation of a parabola about is focal axis. The antenna feed (e.g., dipole or feed horn) moves in a small circular orbit about the axis of the paraboloidal reflector so that the beam of electromagnetic energy reflected from the reflector is conically scanned. It also is possible to achieve conical scanning by utilizing a circularly polarized antenna feed that is capable of simultaneously operating in both a sum and difference signal mode. The two signal modes are combined in a summing circuit with variable phase offset between the mode signals being employed. Cyclic variation of phase offset causes the antenna feed pattern to rotate thereby resulting in conical scanning of the reflected electromagnetic energy. Although satisfactory in some instances, both of these approaches are limited to small conical scan angles (i.e., small cone angles).

SUMMARY OF THE INVENTION

In accordance with this invention, variable wide angle conical scanning is achieved by an antenna arrangement that employs a reflector that is an off-axis sector of a paraboloid of revolution formed by the intersection of the paraboloid and a geometric shell (e.g., a right circular cylinder whose axis is parallel to the focal axis of the paraboloid). Means are provided for rotating the offset paraboloidal reflector about an axis of rotation that extends through the parabolic focus.

Located at the parabolic focus is an antenna feed that directs a beam of elecromagnetic energy along the axis of reflector rotation. With this arrangement, the beam of electromagnetic energy that is reflected from the offset paraboloidal reflector extends along an axis parallel to the parabolic axis. In an embodiment of the invention that utilizes the above-mentioned offset parabolic reflector that is defined by a right circular cylinder, the axis along which the reflected electromagnetic energy travels is coincident with the axis of the right circular cylinder. Thus, as the paraboloidal reflector is rotated about its axis of rotation, wide angle conical scanning is achieved with the conical scanning angle being equal to twice the angle formed between the reflector axis of rotation and the boresight of the beam of reflected energy (e.g., the axis of the right circular cylinder that defines the offset paraboloidal reflector).

To selectively increase and decrease the conical scanning angle, means are provided for tilting the paraboloidal reflector about the reflector focus with the rotational axis of the paraboloidal reflector and the focal axis thereof remaining in substantially coplanar orientation. Tilting the reflector in this manner results in variation in the conical scanning angle of the antenna in which the antenna feed remains at a fixed position and is always focused and aligned along the antenna axis of rotation. Thus, near-maximum antenna efficiency is maintained (i.e., little scan loss occurs) when the antenna is operated over a relatively large range of conical scanning angles (e.g., 60°–120°). In practice, the range of conical scanning angles is limited only by the amount of spillover that can be accepted for a particular design application.

Further advantages of the invention include the fact that the paraboloidal reflector does not have a high moment of inertia and thus can be rotated and tilted by drive motor arrangements and electrical power supplies of reasonable complexity and size. Further, the desired goal of achieving an arrangement that requires no movement of the electronics associated with the antenna and no movement of the RF transmission lines that interconnect the antenna with the electronics is achieved. Not only is the arrangement of the invention suitable for use in variable, wide angle conical scanning applications, but, in addition, both high antenna gain and operation over a wide band of frequencies is achieved. Even further, in embodiments of the invention that utilize a circularly polarized antenna feed, polarization characteristics of the feed are constant over the cone of scan.

DESCRIPTION OF THE DRAWING

These and other features and advantages of the invention will become apparent from the following description which is given as an example and which is illustrated by the accompanying drawing in which.

DETAILED DESCRIPTION

Figure 1:
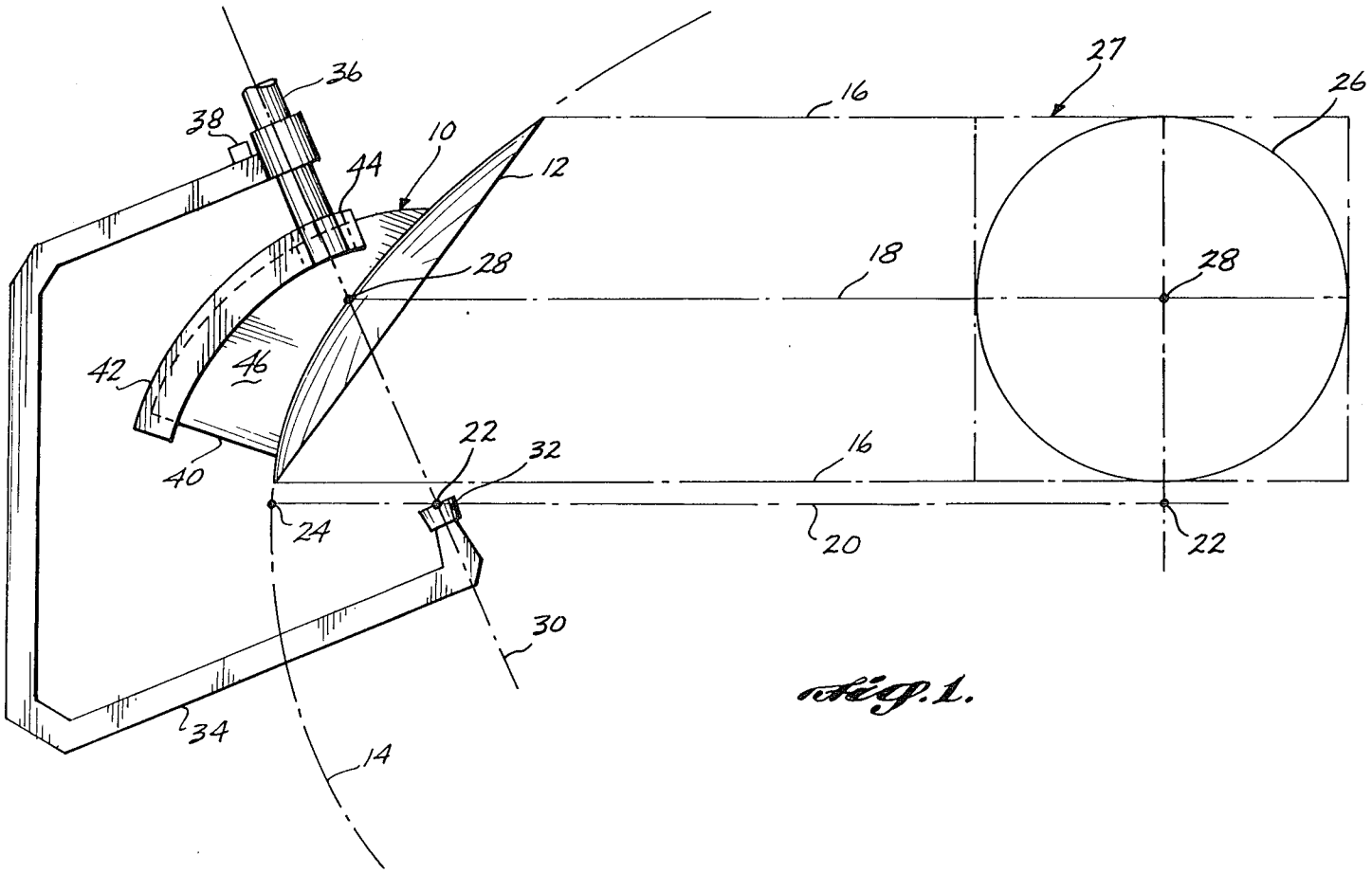
FIG. 1 is a side elevation view that schematically depicts an embodiment of the invention.

As is indicated in FIG. 1, a wide angle conical scanning antenna configured in accordance with this invention (generally denoted by the numeral 10) includes an offset paraboloidal reflector 12. As also is indicated in FIG. 1, such an offset paraboloidal reflector can for formed, for example, by the intersection between a paraboloid of revolution 14 and a right circular cylinder (indicated by dashed lines 16) that a centerline 18 that is spaced apart from and parallel to the axis of revolution of paraboloid 14. As is known in the art, te axis of revolution of a paraboloidal reflector commonly is referred to as the focal axis and hereinafter will be referred to as the parabolic focal axis 20. As further is indicated in FIG. 1, and as is known in the art, parabolic focal axis 20 passes through both the focus 22 and the vertex 24 of paraboloid of revolution 14.

With continued reference to FIG. 1, the depicted offset paraboloidal reflector 12 has a circular projection 26 when viewed along centerline 18 of right circular cylinder 16. This circular projection has a radius equal to that of right circular cylinder 16 and forms the projected aperture of offset paraboloidal reflector 12, with the focus 22 of the paraboloid of revolution 14 being located outside the projected aperture on a line that is orthogonal to centerline 18 and passes through the center of the projected aperture of offset paraboloidal reflector 12.

Offset paraboloidal reflectors of configurations other than the configuration illustrated in FIG. 1 are known to those skilled in the art and can be utilized in the practice of the invention. In this regard, numerous geometric shells other than the right circular cylinder 16 of FIG. 1 can be employed. For example, as is shown by dashed lines 27, a square projected aperture can be formed.

Regardless of the manner in which the offset paraboloidal reflector is formed (i.e., shaped), the reflector is rotated about an axis that extends through focus 22 of paraboloid of revolution 14 and the geometric center of the projected aperture of offset paraboloidal reflector 12 (indicated in FIG. 1 by reference numeral 28). In FIG. 1, this rotational axis for offset paraboloidal reflector 12 is indicated by reference numeral 30.

Further, in accordance with this invention, each embodiment of the invention includes an antenna feed 32 that is located at the parabolic focus 22, which coincides with the intersection of parabolic focal axis 20 and axis of rotation 30. In the practice of the invention, various known arrangements can be utilized as antenna feed 32. For example, in embodiments of the invention where operation is desired over a relatively wide frequency band, antenna feed arrangements such as small spiral antennas, log-periodic dipole arrays and other wide band devices that provide a relatively narrow radiation lobe can be utilized.

To maintain antenna feed 32 in the desired, fixed location, the arrangement depicted in FIG. 1 includes a substantially U-shaped support arm 34 that extends between antenna feed 32 and a circular support sleeve 36 that coaxially surrounds rotational axis 30 of offset paraboloidal reflector 12. In this depicted arrangement, antenna feed support arm 34 includes an electrical connector 38 for interconnection with conventional transmission lines (not shown in FIG. 1) that provide electrical interconnection between antenna feed 32 and the RF system that utilizes antenna 10.

Located at the terminus of support sleeve 36 is a rotation and tilt mechanism 40 that is configured and arranged to rotate offset paraboloidal reflector 12 about rotation axis 30 and, as shall be described in more detail, to move paraboloidal reflector 12 through an arcuate path of equal radius about focus 22 of paraboloid of revolution 14. This arcuate movement or tilt of paraboloidal reflector 12 provides variable conical scanning of the resultant RF beam (or beams in a multimode feed arrangement) over a relatively wide range of cone angles.

Figure 2:
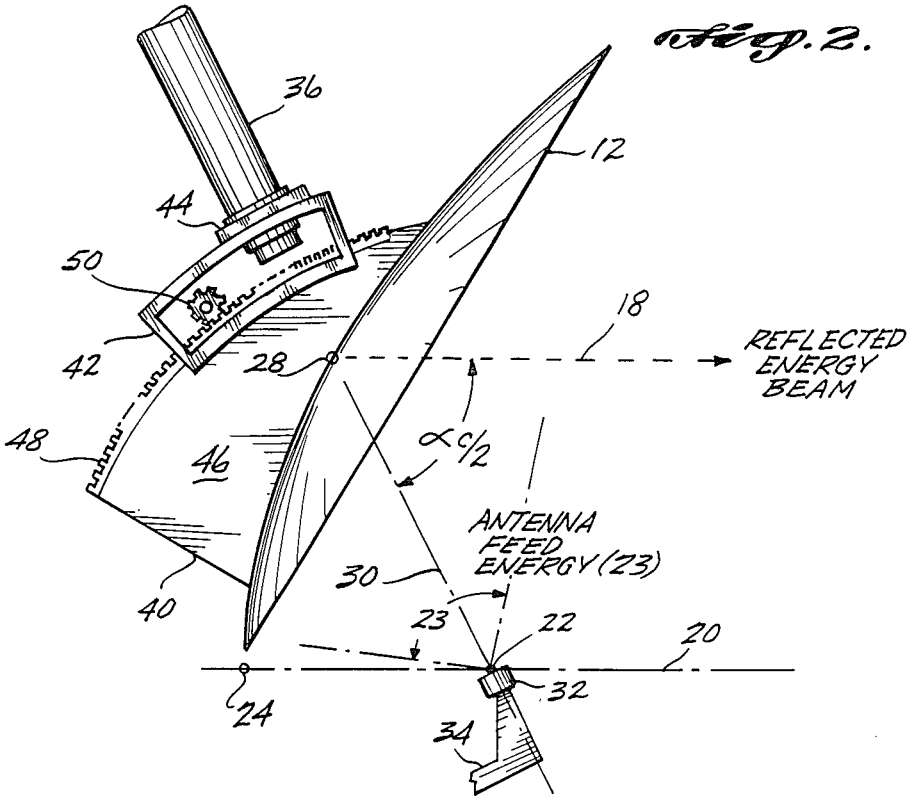
FIG. 2 is an enlarged side elevation view of a portion of the arrangement depicted in FIG. 1 which partially illustrates a combined rotation and tilt mechanism for rotating the paraboloidal reflector utilized in the invention to provide a wide angle conical scan and for tilting the paraboloidal reflector to provide variable cone angle conical scanning.

Referring now to both FIGS. 1 and 2, the rotation and tilt mechanism 40 of the depicted embodiment basically includes an arcuately contoured base 42, with support sleeve 36 being journaled to one end of base 42 by a conventional bearing 44. Extending outwardly from the edges of base 42 are two spaced-apart strut plates 46 that are parallel to one another and are joined to convex outer surface of offset paraboloidal reflector 12. As shall be described in more detail with regard to FIGS. 4 and 5, strut plates 46 are configured to slide along bearing slots that are formed in arcuately contoured base 42 with each strut plate 46 including a rack (48 in FIG. 2) that is driven by a pinion 50 so that offset paraboloidal reflector 12 can be arcuately swung (tilted) about focus 22 of paraboloid of revolution 14. As also shall be described in more detail relative to FIGS. 4 and 5, a circular extension of support sleeve 36 forms a drive shaft 52 that extends inwardly along the axis of rotation for rotating offset paraboloidal reflector 12 about the axis of rotation 30.

In FIG. 2, rotation and tilt mechanism 40 is shown in the tilt position that provides the central or mid-value for the desired range of conical scanning. Specifically, rotation and tilt mechanism 40 is positioned so that geometric center 28 of paraboloidal reflector 12 lies on rotational axis 30. In this condition, as is shown in FIG. 2, the beam of electromagnetic energy 23 that is supplied by antenna feed 32 (FIG. 1) extends along axis of rotation 30 and impinges on geometric center 28 of the projected aperture of offset paraboloidal reflector 12. As is indicated in FIG. 2, the beam of energy that is reflected from offset paraboloidal reflector 12 travels along centerline 18 of the right circular cylinder (or other geometric shell) utilized to define offset paraboloidal reflector 12. In FIG. 2, the tilt angle formed between rotational axis 30 of offset paraboloidal reflector 12 annd centerline 18 is denoted as $\alpha_c/2$. Because centerline 18 is parallel to parabolic focal axis 20, the angle formed between these two axes also is $\alpha_c/2$.

Figure 3:
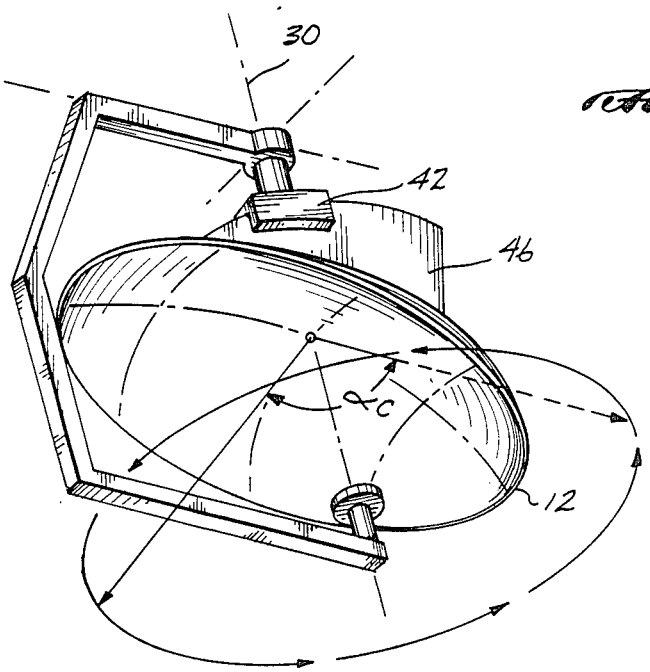
FIG. 3 schematically illustrates rotation of the paraboloidal reflector of the invention to illustrate the wide angle conical scan that is achieved by the invention.

As is schematically depicted in FIG. 3, when offset paraboloidal reflector 12 of the embodiment depicted in FIG. 2 is continuously rotated about axis of rotation 30, the beam of energy that is reflected from offset paraboloidal reflector 12 is swept along a cone that exhibits a cone angle $\alpha_c$.

Figure 4:
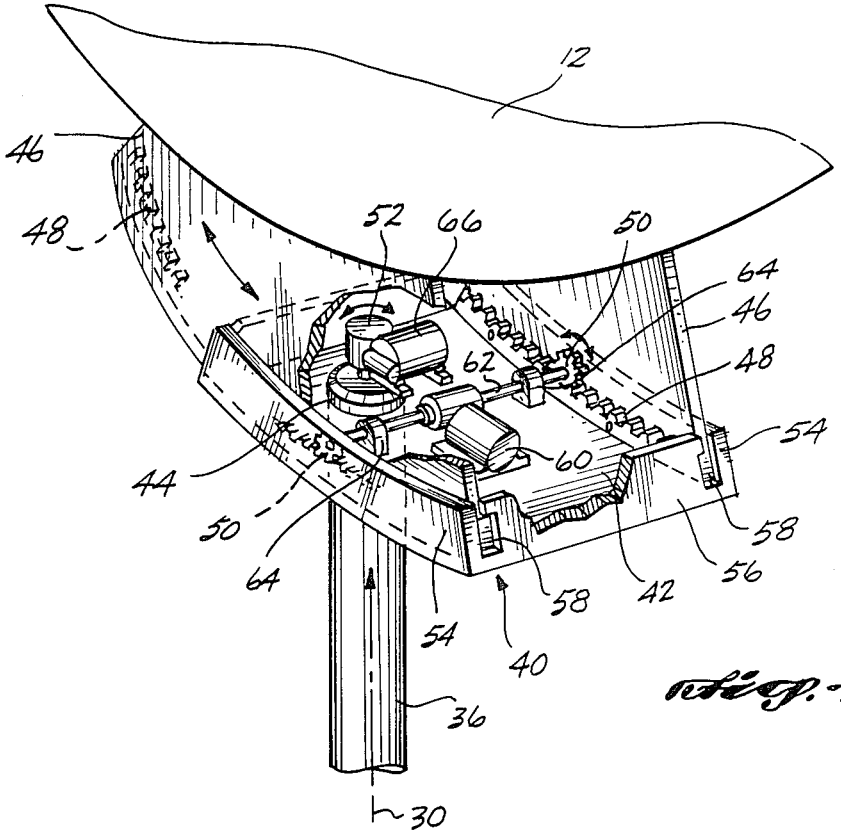
FIG. 4 is a partial isometric view depicting one arrangement that can be utilized for combined rotation and tilt control of the offset paraboloidal reflector of the invention.
Figure 5:
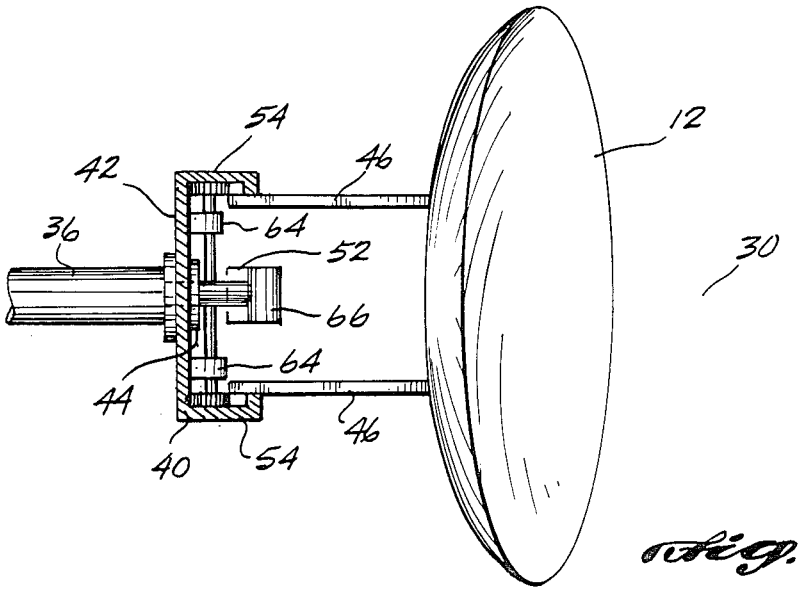
FIG. 5 is a top elevation view of the rotation and tilt arrangement depicted in FIG. 4.

Understanding now the manner in which embodiments of the invention are configured and arranged for providing conical scanning at the central cone angle, reference is taken to FIGS. 4 and 5, which illustrate one realization of rotation and tilt mechanism 40. As is most clearly depicted in FIG. 4, arcuately contoured base 42 includes flanges 54 that are orthogonal to and prooject outwardly from the curved edges of arcuately contoured base 42. Located along the ends of arcuately contoured base 42 are orthogonally extending flanges 56 which are shaped to define substantially rectangular bearing slots 58 between each end of a flange 56 and the outwardly extending base flanges 54. Mounted at the lower end of each strut plate 46 is a rack 48 that is dimensioned and contoured so that the racks and lower edges of strut plates 46 slide freely along arcuately contoured base 42 within the confines of slots 58.

Mounted near the center of arcuately contoured base 42 is a reversible drive motor 60 which can be achieved to rotate a shaft 62 that extends between two pinion gears 50 that are engaged with the racks 48. In FIG. 4, drive motor 60 is of the type commonly referred to as a gear head motor, with shaft 62 being journaled in two spaced-apart bearing blocks 64.

Also depicted in FIGS. 4 and 5 is the previously mentioned arrangement for rotating offset paraboloidal reflector 12 about rotational axis 30. As was previously discussed, support sleeve 36 is journaled to arcuately contoured base 42 by means of a bearing 44 that is retained in base 42. Extending upwardly from the end of support sleeve 36 is a drive shaft 52 that includes longitudinally extending gear teeth. Engaged with the teeth formed in drive shaft 52 is a reversible drive motor 66. Like drive motor 60, the depicted drive motor 66 is of the variety commonly referred to as a gear head motor.

Figure 6:
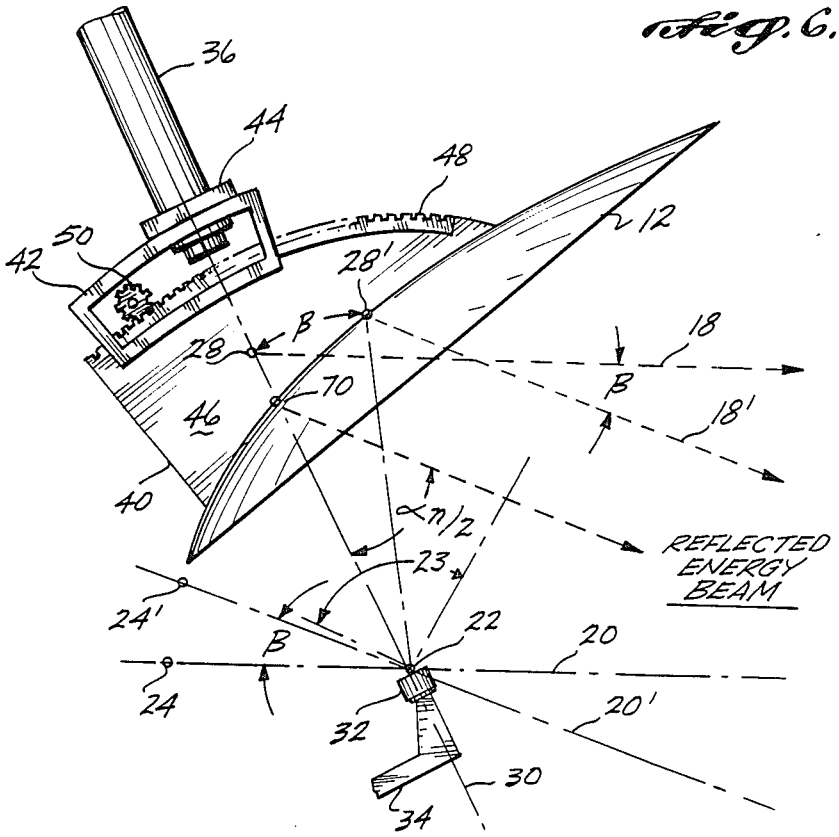
FIG. 6 is a side elevation view that illustrates placement of the offset paraboloidal reflector used in the invention in the minimum cone angle position.

In view of the above-discussed arrangment of the depicted rotation and tilt mechanism 40, it can be recognized that operation of drive motor 60 causes offset paraboloidal reflector 12 to be swung arcuately about focal point 22 and through rotational axis 30 of offset paraboloidal reflector 12. More specifically, as is shown in FIG. 6, when offset paraboloidal reflector 12 is moved arcuately through rotational axis 30 (fitted about focal point 22), parabolic focal axis 20 swings into a position denoted by dashed line 20' in FIG. 6. That is, parabolic focal axis 20 swings through an angle $\alpha$ in FIG. 6. As is indicated in FIG. 6, this causes the beam of electromagnetic energy that is directed along rotational axis 30 to impinge upon a new region 70 of offset paraboloidal reflector 12 that is offset somewhat from geometric center 28 of the projected aperture. Thus, the beam of electromagnetic energy that is reflected from offset paraboloidal reflector 12 forms an angle $\alpha_n/2$ with rotational axis 30 that is equal to $\alpha_c/2-\beta$, where $\alpha_c$ defines the central cone angle in the manner described relative to FIG. 2 and $\beta$ is the angle through which offset paraboloid reflector 12 and corresponding focal axis 20 are tilted (i.e., the decrease in tilt angle). Although now shown in the Figures, it can be recognized that operating drive motor 60 to swing paraboloidal reflector 12 in a direction opposite that shown in FIG. 6 (increasing the tilt angle), results in conical scanning at a cone angle that exceeds $\alpha_c$. In this regard, based upon current experimental data and calculations, the invention can be embodied to provide wide angle, variable conical scanning in which the cone angle scanned can be varied at least between approximately 120° and 60°.

Figure 7:
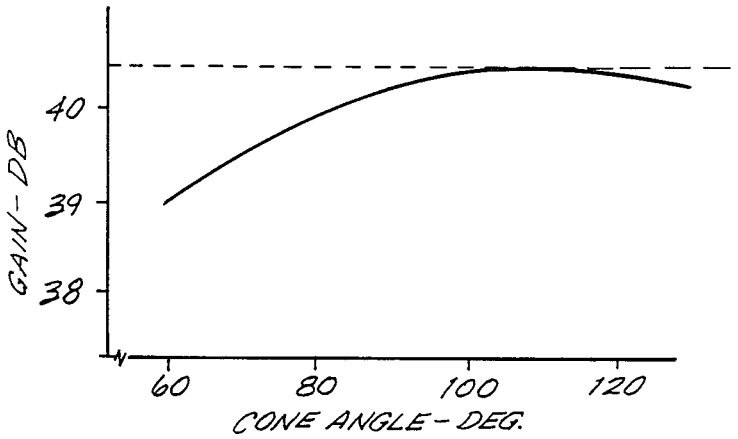
FIG. 7 graphically depicts variation in antenna gain as a function of conical scan cone angle for one particular realization of the invention.

It will be recognized by those skilled in the art that tilting offset parabolic reflector 12 in the manner described in FIG. 6 will result in some loss in the signal strength of the reflected energy beam since the change in tilt angle results in displacement of offset paraboloidal reflector 12 from the optimum position for intercepting the beam of electromagnetic energy supplied by antenna feed 32. That is, because of the tilt, a small amount of the feed energy does not impinge on the reflector. The result is a slight increase in "spill-over loss" with a corresponding decrease in antenna efficiency. However, the loss experienced is less than the defocused losses experienced in prior art arrangements that are configured for equivalent variation in scan angle. In this regard, FIG. 7 graphically depicts the efficiency loss experienced with an embodiment of the invention in which antenna feed 32 is a spiral antenna that is operated in the sum mode at a frequency of 3 gigahertz with an offset parabolic reflector having a projected aperture 50 inches in diameter. As is shown in FIG. 7, in this embodiment, a 1.5-decibel loss in antenna gain is experienced as the cone angle of the conical scanning is varied between 120° and 60°.

It will be recognized by those skilled in the art that the amount of spill-over loss that is experienced at the maximum and minimum scan angle positions is a function both of projected aperture size and geometry. Thus, in some instances in which system constraints do not permit increasing reflector size to attain the desired level of spill-over loss (i.e., efficiency), it may be advantageous to employ different reflector aperture geometry. For example, the square aperture geometry indicated by dashed lines 27 in FIG. 1 will exhibit less spill-over loss than the circular aperture that is indicated by identification numeral 26.

In view of the above-described manner in which the invention is configured for rotation about rotational axis 30 of offset paraboloidal reflector 12 and for tilt of offset paraboloidal reflector 12 to cause a decrease in cone angle of conical scanning, it can be recognized that an antenna configured in accordance with the invention can be driven to achieve various scanning patterns including conventional conical scanning, spiral scanning, sector scanning and raster scanning. In addition, the invention can be operated to provide a fixed position beam of electromagnetic energy and, through appropriate drive control circuits, can be configured for autotracking and programmed tracking operation. Further, when equipped with a suitable antenna feed such as a small spiral antenna element, the invention can be operated as an angle-of-arrival antenna system.

Further, those skilled in the art will recognize that various arrangements can be utilized as rotation and tilt mechanism 40 and that other changes and modifications can be made to the above-described exemplary embodiment of the invention, without departing from the scope and the spirit of the invention. Also, those skilled in the art will recognize that, because of the principle of reciprocity, the above invention functions as well in a receiving capacity as in a transmitting capacity as mainly described above.

The embodiments of the invention in which an exclusive property or privilege is claimed are defined as follows:

1. A variable angle conical scanning antenna comprising:

an offset paraboloidal reflector having a surface contour that is defined by an offset geometric region of a paraboloid of revolution formed by rotating a parabola about its focal axis, said geometric region of said paraboloid of revolution having a geometric center point;

means for rotating said offset paraboloidal reflector about an axis of rotation that extends through the focus of said paraboloid of revolution;

antenna feed means positioned at said focus of said paraboloid of revolution for directing electromagnetic energy toward said offset paraboloidal reflector; said electromagnetic energy being directed substantially along said axis of rotation; and means for tilting said offset paraboloidal reflector about said focus of said paraboloid of revolution with said focal axis of said paraboloid of revolution remaining substantially coplanar with said axis of rotation of said paraboloidal reflector.

2. The variable angle conical scanning antenna of claim 1, whereins aid offset geometric region and thus the boundary of said offset paraboloidal reflector are defined by the intersection between said paraboloid of revolution and a right circular cylinder whose axis of symmetry is parallel with said focal axis of said paraboloid of revolution.

3. The variable angle conical scanning antenna of claim 2, wherein said means for rotating said offset paraboloidal reflector and said means for tilting said offset paraboloidal reflector are combined in a rotation and tilt means that is mounted to said offset paraboloidal reflector.

4. The variable angle conical scanning antenna of claim 3, wherein said rotation and tilt means includes:

a base having a pair of spaced-apart slots that define the path through which said offset paraboloidal reflector can be tilted;

a pair of spaced-apart, substantially parallel strut plates that extend outwardly from said offset paraboloidal reflector with the outward portion of each of said strut plates being slidably retained in said slots of said base;

first drive means for moving said strut plates along said slots to tilt said offset paraboloidal reflector;

a support sleeve extending coaxially along said axis of rotation and journaled to said base to allow rotation of said base and said offset paraboloidal reflector about said axis of rotation, said support sleeve having an end region that extends through said base; and second drive means engageable with said end of said support sleeve that extends through said base for rotating said base and said offset paraboloidal reflector about said support sleeve.

5. The variable angle conical scanning antenna of claim 4, further including a support arm that extends between said support sleeve and the focus of said paraboloid of reflection with said antenna feed means being mounted on said support arm.

6. The variable angle conical scanning antenna of claim 1, wherein said offset geometric region of said paraboloid of revolution and thus the boundary of said offset paraboloidal reflector are defined by the intersection between said paraboloid of revolution and a geometric shell of substantially square cross section with the axis of said geometric shell being substantially parallel to said focal axis of said paraboloid of revolution.

7. The variable angle concial scanning antenna of claim 6, wherein said means for rotating said offset paraboloidal reflector and said means for tilting said offset paraboloidal reflector are combined in a rotation-and-tilt means that is mounted to said offset paraboloidal reflector.

8. The variable angle concial scanning antenna of claim 7, wherein said rotation-and-tilt means includes:

a base having a pair of spaced-apart slots that define the path through which said offset paraboloidal reflector can be tilted;

a pair of spaced-apart, substantially parallel strut plates that extend outwardly from said offset paraboloidal reflector with the outward portion of each of1 said strut plates being slidably retained in said slots of said base;

first drive means for moving said strut plates along said slots to tilt said offset paraboloidal reflector;

a support sleeve extending coaxially along said axis of rotation and journaled to said base to allow rotation of said base and said offset paraboloidal reflector about said axis of rotation, said support sleeve having an end region that extends through said base; and second drive means engageable with said end of said support sleeve that extends through said base for rotating said base and said offset paraboloidal reflector about said support sleeve.

9. The variable angle conical scanning antenna of claim 8, further including a support arm that extends between said support sleeve and the focus of said paraboloid of reflection with said antenna feed means being mounted on said support sleeve.

10. The variable angle conical scanning antenna of claim 1, wherein said means for tilting said offset paraboloidal reflector allows said antenna to be operated over a relatively large range of conical scanning angles, while maintaining near-maximum antenna efficiency.

11. The variable angle conical scanning antenna of claim 10, wherein said elatively large range of conical scanning angles is roughly equal to a 60° range.

12. The variable angle conical scanning antenna of claim 11, wherein said relatively large range of conical scanning angles extends roughly between 60° and 120°.

13. The variable angle conical scanning antenna of claim 10, wherein said nearmaximum antenna efficiency corresponds to less than a two-decibel loss in antenna gain as the conical scanning angle varies over said relatively large range.

14. A variable angle conical scanning antenna comprising:

an offset reflector defined by the intersection of a paraboloid of revolution and a right circular cylinder whose axis of symmetry is parallel to and spaced apart from the focal axis of said paraboloid of revolution with the diameter of said right circular cylinder being less than the distance between said axis of symmetry of said right circular cylinder and said focal axis of said paraboloid of revolution;

first drive means for rotating said offset paraboloidal reflector about an axis that is coincident the focus of said paraboloid of revolution;

second drive means for tilting said offset paraboloidal reflector about said focus of said paraboloid of revolution while maintaining said axis of rotation substantially coplanar with said focal axis and said axis of symmetry of said right circular cylinder; and an antenna feed positioned at said focus of said paraboloid of revolution for radiating RF energy substantially along said axis of rotation and toward said offset paraboloidal reflector.

15. The variable angle conical scanning antenna of claim 14, wherein said tilt means is arranged for tilting said offset paraboloidal reflector about a central position in which said axis of rotation intersects said paraboloid of revolution at substantially the same point as said axis of symmetry of said right circular cylinder intersects said paraboloid of revolution.

* * * * *